US007581622B2

(12) United States Patent
Amano

(10) Patent No.: US 7,581,622 B2
(45) Date of Patent: Sep. 1, 2009

(54) CONTROL DEVICE FOR ELEVATOR

(75) Inventor: Masaaki Amano, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 607 days.

(21) Appl. No.: 10/581,456

(22) PCT Filed: Oct. 21, 2004

(86) PCT No.: PCT/JP2004/015579

§ 371 (c)(1),
(2), (4) Date: Jun. 1, 2006

(87) PCT Pub. No.: WO2006/043324

PCT Pub. Date: Apr. 27, 2006

(65) Prior Publication Data

US 2009/0020372 A1 Jan. 22, 2009

(51) Int. Cl.
*B66B 1/20* (2006.01)

(52) U.S. Cl. ..... 187/384; 187/392

(58) Field of Classification Search ..... 187/247, 187/248, 380–388, 391–396
See application file for complete search history.

(56) References Cited

U.S. PATENT DOCUMENTS

| | | | | |
|---|---|---|---|---|
| 6,382,363 | B1 * | 5/2002 | Friedli | 187/384 |
| 6,772,862 | B2 * | 8/2004 | Friedli | 187/247 |
| 7,093,693 | B1 * | 8/2006 | Gazdzinski | 187/384 |
| 7,145,433 | B2 * | 12/2006 | Gerstenkorn | 340/5.22 |
| 7,319,966 | B2 * | 1/2008 | Friedli et al. | 705/1 |

FOREIGN PATENT DOCUMENTS

| | | |
|---|---|---|
| JP | 6-329344 | 11/1994 |
| JP | 2000-272850 | 10/2000 |
| JP | 2001-243515 | 9/2001 |
| JP | 2002-220163 | 8/2002 |
| JP | 2002-220177 | 8/2002 |
| JP | 2004-500294 | 1/2004 |
| JP | 2004-51342 | 2/2004 |
| JP | 2004-075361 | 3/2004 |
| JP | 2004-250191 | 9/2004 |

* cited by examiner

*Primary Examiner*—Jonathan Salata
(74) *Attorney, Agent, or Firm*—Oblon, Spivak, McClelland, Maier & Neustadt, P.C.

(57) ABSTRACT

An elevator control system high in security and capable of enhancing operation efficiency is realized. In a system in which an elevator group management device which manages a plurality of elevators as a group is installed, a validation device is installed at a security gate installed at an entrance of a building, and when validation is made by the validation device, the security gate opens to allow a validated person to move to an elevator hall of an entrance floor, the elevator control system includes validation information transmission means which transmits validation information to a corresponding bank out of a plurality of banks of the elevator hall based on destination floor validation information of the validation device, indoor population counting means which counts indoor population of each floor from the validation information, car assigning means which assigns a car to each destination floor of a passenger from the validation information, destination floor display means which displays a destination floor on the entrance floor hall for each assigned car, and call automatic registration means which automatically registers a destination call of the destination floor in the car when detecting riding of the passenger.

3 Claims, 5 Drawing Sheets

CONTROL DEVICE FOR ELEVATOR

TECHNICAL FIELD

The present invention relates to an elevator control system which assigns a car in accordance with a destination floor from information validated at a security gate, and automatically registers a destination call.

BACKGROUND ART

In recent years, in order to prevent crimes and entry of unknown persons in buildings, systems which provide security gates at entrances of the buildings, and make entry into elevator halls possible only by operation of predetermined validating means (for example, non-contact IC cards and living body personal identifications of fingerprints, irises and the like) come to be introduced. These systems are installed basically for enhancement of security of the buildings in many cases.

For such systems, several proposals are conventionally made. For example, there are the system which is constructed so that when a person who comes to the security gate is identified and determined as a resident, the gate is opened and at the same time, an elevator is called to the elevator hall on the entrance floor (for example, see Patent Document 1), the system in which an elevator hall operation panel on which a destination floor is registered is provided at the elevator hall on the entrance floor though not linked to the security gate, and when this is operated, a car which responds to this is displayed beside the destination button of the corresponding floor (for example, see Patent Document 2), the system which registers a landing call of the entrance floor when a person identification device at the entrance floor which grants entry admission identifies a person, and registers a destination call in the car on which riding is detected at the entrance floor (for example, see Patent Document 3), and the like.

Patent Document 1: Japanese Patent Laid-Open No. 2004-75361

Patent Document 2: Japanese Patent Laid-Open No. 2000-272850

Patent Document 3: Japanese Patent Laid-Open No. 2004-51342

DISCLOSURE OF THE INVENTION

Problems to be Solved by the Invention

However, the conventional systems have the following problems. The conventional systems cannot respond to the case where a plurality of floors are divided into, for example, a high-level, a middle-level and a low-level, and a plurality of banks such as a high-level bank, a middle-level bank, and a low-level bank exist, as in a super high-rise building. Since the conventional systems only call elevators to the elevator halls on the entrance floors, they cannot assign the cars in accordance with the number of passengers and the destination floors. Though they can identify the individuals with the information of the validation devices, they cannot choose the operation corresponding to the information.

The present invention is made to solve the above described problems, and has an object to provide an elevator control system capable of assigning a car in accordance with a destination floor from information validated at a security gate, automatically registering a destination call, and realizing enhancement of security and enhancement of operation efficiency and usability.

Means for Solving the Problems

The present invention provides an elevator control system in which an elevator group management device which manages a plurality of elevators as a group is installed, a validation device is installed at a security gate installed at an entrance of a building, and when validation is made by the validation device, the security gate opens to allow a validated person to move to an elevator hall of an entrance floor, characterized by comprising:

validation information transmission means which transmits validation information to a corresponding bank out of a plurality of banks of the elevator hall based on destination floor validation information of said validation device;

indoor population counting means which counts indoor population of each floor from said validation information;

car assigning means which assigns a car to each destination floor of a passenger from said validation information;

destination floor display means which displays a destination floor on the entrance floor elevator hall for each assigned car; and call automatic registration means which automatically registers a destination call of the destination floor in the car when detecting riding of the passenger.

Also, an elevator control system in which an elevator group management device which manages a plurality of elevators as a group is installed, a validation device is installed at a security gate installed at an entrance of a building, and when validation is made by the validation device, the security gate opens to allow a validated person to move to an elevator hall of an entrance floor, characterized by comprising:

validation information transmission means which transmits validation information to a corresponding bank out of a plurality of banks of the elevator hall based on destination floor validation information of said validation device;

car assigning means which assigns a car to each destination floor of a passenger from said validation information;

destination floor display means which displays a destination floor on the entrance floor elevator hall for each assigned car;

call automatic registration means which automatically registers a destination call of the destination floor in the car when detecting riding of the passenger; and special operation selection means which selects an operation peculiar to a user from personal validation information of said validation device.

Moreover, an elevator control system in which an elevator group management device which manages a plurality of elevators as a group is installed, a validation device is installed at a security gate installed at an entrance of a building, and when validation is made by the validation device, the security gate opens to allow a validated person to move to an elevator hall of an entrance floor, characterized by comprising:

validation information transmission means which transmits validation information to a corresponding bank out of a plurality of banks of the elevator hall based on destination floor validation information of said validation device;

car assigning means which assigns a car to each destination floor of a passenger from said validation information; and standby time adjustment means which adjusts a door-opened standby time at the elevator hall of the entrance floor in accordance with a distance from said security gate to the corresponding bank.

EFFECT OF THE INVENTION

The elevator control system of this invention selects an optimal car in accordance with the number of passengers for each destination floor, and automatically dispatches the car to the entrance floor elevator hall, automatically registers a call of the destination floor at the time of riding, and displays the destination floor on the elevator hall, when validation is made at the security gate. Therefore, not only enhancement of security, but also enhancement of operation efficiency and usability can be realized. When the personal information such as a female, a physically handicapped person and a VIP is included in the validation information, a special operation corresponding to the personal information (for example, the operation only for women, the operation for a physically handicapped person, a VIP operation or the like) can be automatically selected.

DESCRIPTION OF SYMBOLS

Figure 1:
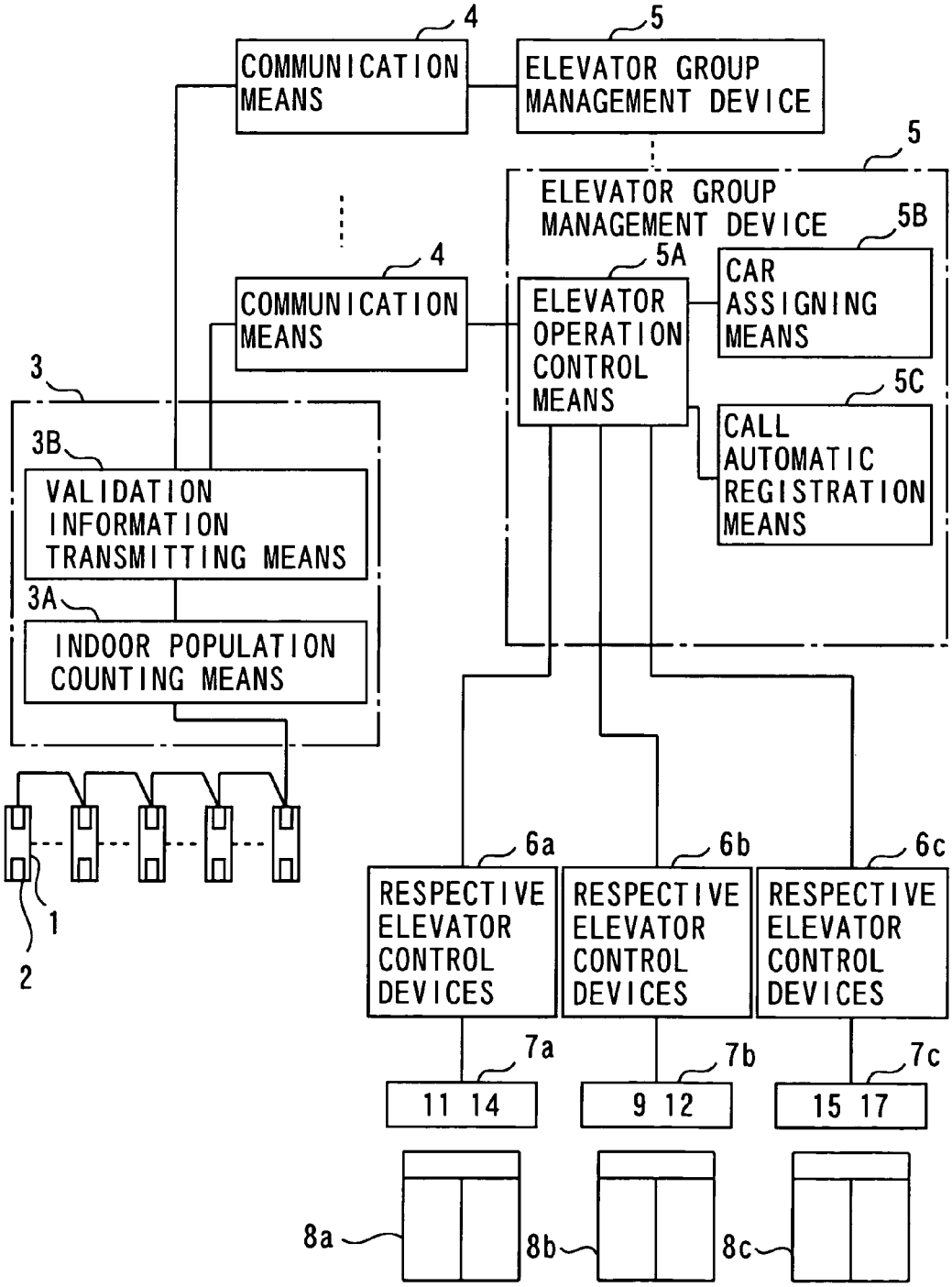
FIG. 1 is a block diagram showing a construction of an elevator control system in embodiment 1 of this invention.

1 security gate
2 validation device
3 validation control device
3A indoor population counting means
3B validation information transmitting means
4 communication means
5 elevator group management device
5A elevator operation control means
5B car assigning means
5C call automatic registration means
6*a*~6*c* respective elevator control devices
7*a*~7*c* destination floor display devices
8*a*~8*c* respective elevators
9 super high-rise building
10 entrances
11 elevator hall
11*a*~11*c* respective bank halls

BEST MODE FOR CARRYING OUT THE INVENTION

In order to describe this invention in more detail, the invention will be described with reference to the attached drawings.

Embodiment 1

FIG. 1 is a block diagram showing a construction of an elevator control system in embodiment 1 of this invention.

Reference numeral 1 denotes a security gate, and reference numeral 2 denotes a validation device mounted to the security gate, which is constructed by a non-contact card reader and a living body identification device of fingerprints, palm prints, irises or the like, for example. Reference numeral 3 denotes a validation control device, which is constructed by indoor population counting means 3A which counts population in the building on each floor from destination floor validation information, and validation information transmitting means 3B which transmits the validation information to a corresponding bank out of a plurality of banks of an elevator hall. Reference numeral 4 denotes communication means for connecting the validation control device 2 and an elevator group management device 5, reference numeral 5 denotes the elevator group management device which manages a plurality (three are shown in this embodiment) of elevators in group, which is constructed by elevator operation control means 5A which performs a general operation control, car assigning means 5B which assigns cars in accordance with destination floors, and automatic registration means 5C which registers a call of the entrance floor and automatically registers a car call of a destination floor when riding is detected. The above described operation control means 5A includes special operation selection means, which performs a special operation of the elevator based on the personal information. The personal information used here means the personal information such as a female, a physically handicapped person, and a VIP, for example, and the selected car performs a special operation corresponding to the personal information, for example, an operation only for women, an operation for a physically handicapped person, a VIP operation and the like. The operation control means 5A includes a door-opened standby time adjusting means (not shown) which adjusts door-opened standby time at the elevator hall of the entrance floor in accordance with the distance from the security gate 1 to the corresponding bank. Reference numerals 6*a* to 6*c* denote respective elevator control devices, reference numerals 7*a* to 7*c* denote destination floor display devices which are placed at the elevator hall of the entrance floor, and display the destination floors of respective elevators 8*a* to 8*c*. It is not necessary to provide an elevator hall button on the entrance floor, but an ordinary elevator hall button may be placed for backup in case of abnormality of the validation device 2.

Next, a structure of a building assumed by this invention will be described.

Figure 2:
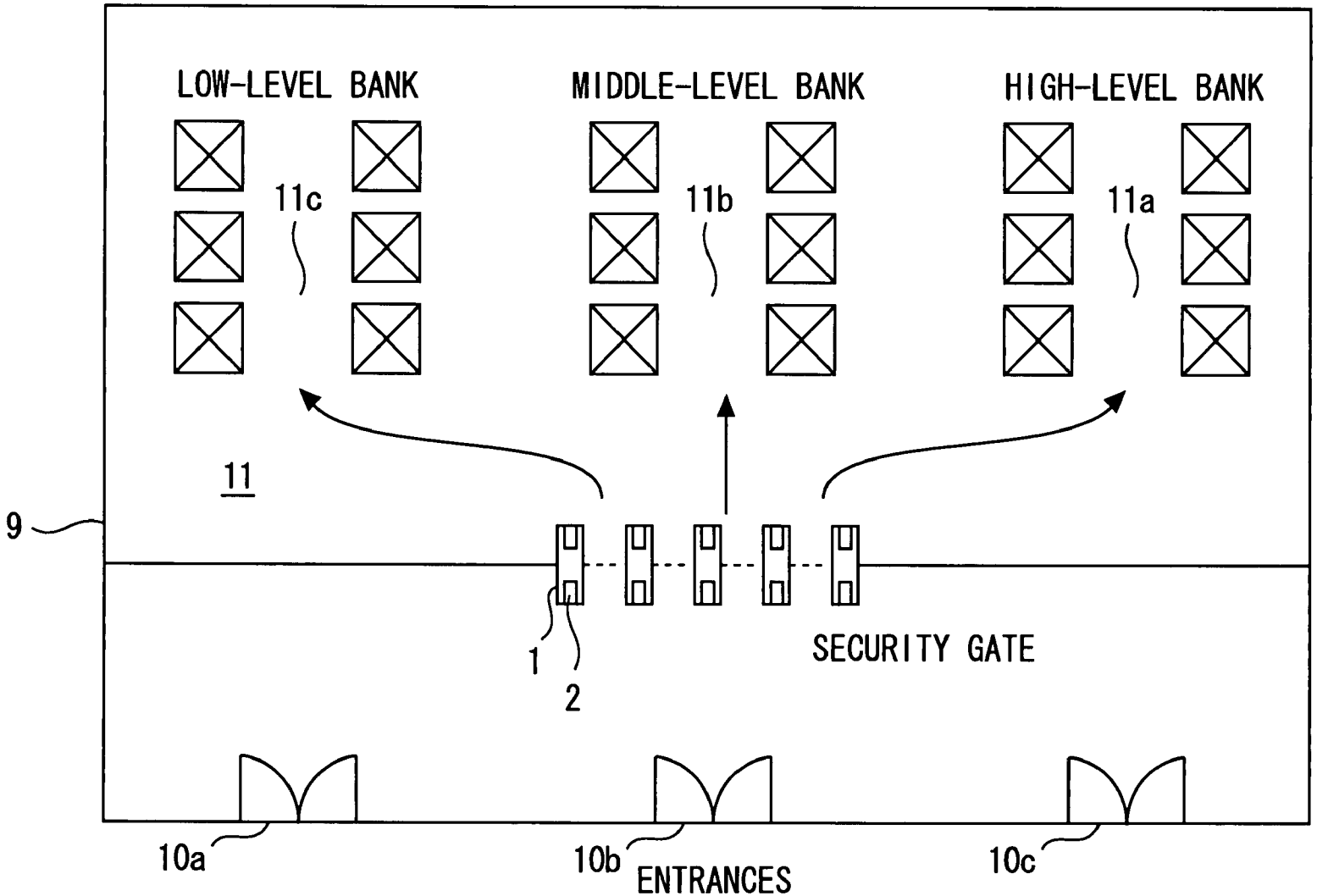
FIG. 2 is a plane view showing a structure of a building which is assumed to be an example to which the elevator control system in the embodiment 1 of this invention is applied.

FIG. 2 is a plane view showing a structure of a building which is assumed to be an example to which the elevator control system in the embodiment 1 of this invention is applied.

When a user enters the building from one of a plurality of entrances 10*a* to 10*c* of a super high-rise building 9, the passenger operates the validation device 2, and thereby goes through the security gate 1 and enters an elevator hall 11. At this time, call registration is performed for the corresponding bank, since the elevator hall 11 is divided into a high-level bank ball 11*a*, a middle-level bank hall 11*b* and a low-level bank hall 11*c*. The structure of the building is such that unless the users pass through the security gate 1, they cannot enter the elevator hall 11. Then, the user goes to one of the elevator halls 11*a* to 11*c* of the banks in which the floor for his or her use exists. At this time, the call registration is already made, and the user waits for arrival of a car in front of the car with his or her destination floor displayed. For example, when the service floors of the middle-level bank are 15th floor to 25th floor, when a resident of the 20th floor passes through the security gate 1, the resident goes ahead to the middle bank hall 11*b*.

Figure 3:
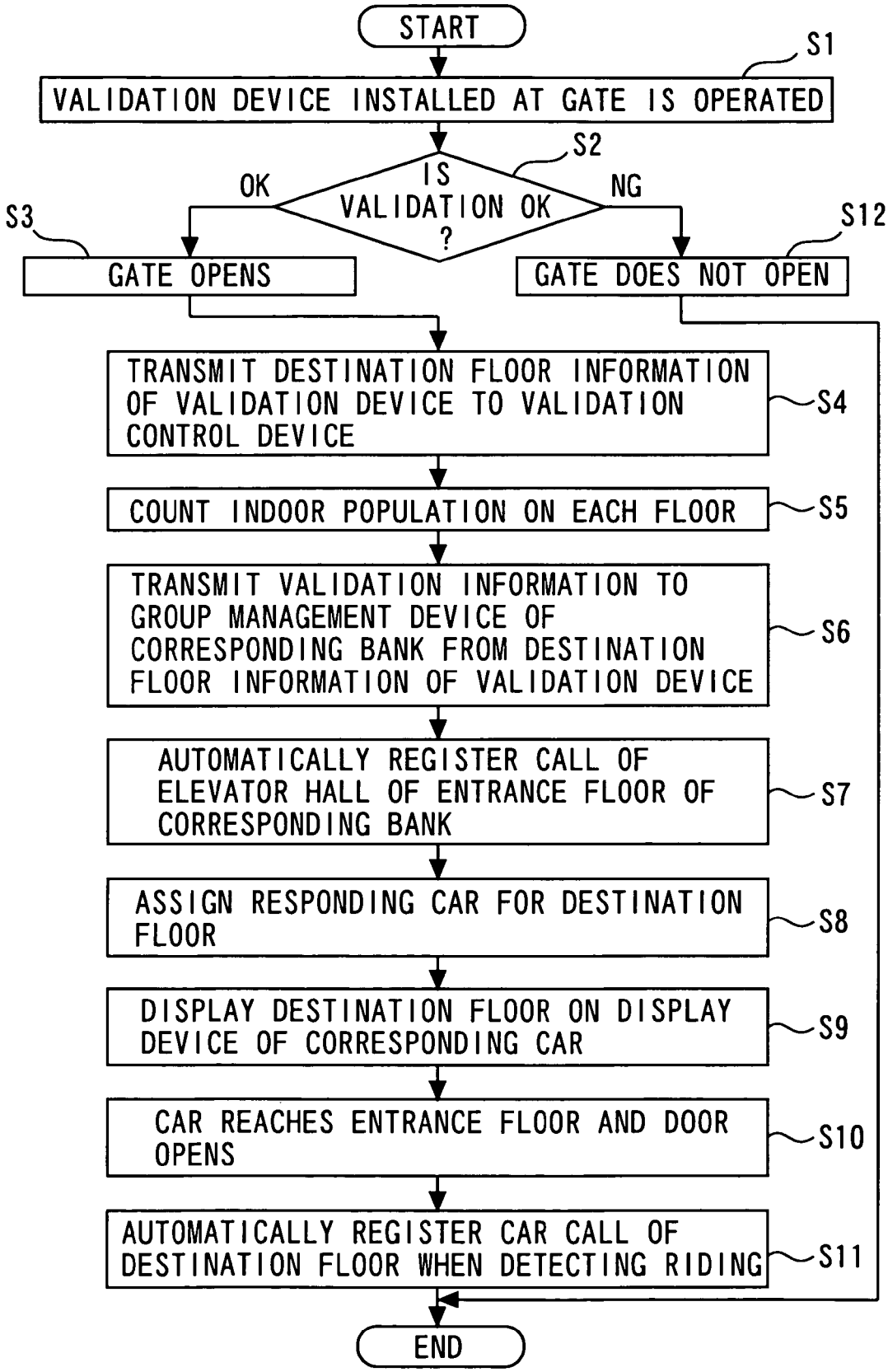
FIG. 3 is a flowchart showing an operation procedure of the elevator control system in the embodiment 1 of this invention.

Next, an operation procedure of the elevator control system in the embodiment 1 of this invention will be described based on a flowchart in FIG. 3.

When a step S1 detects that the validation device 2 placed at the security gate 1 operates, a step S2 determines OK or NG of the validation result. If the validation result is OK, a step S3 opens the security gate 1, a step S4 transmits the destination floor information of the validation device 2 to the validation control device 3, and a step S5 counts indoor population on each floor by the indoor population counting means 3A. When this information is linked to, for example, the building management system (not shown), this information can be applied to the functions of turning off the illumination of a corresponding floor, making the elevator service temporarily unavailable and the like when there is no person on the floor of the building by transmitting the indoor population information of each floor. Then, a step 6 transmits the validation information to the elevator group management device 5 of the corresponding bank, and a step S7 automatically registers the elevator hall call of the entrance floor of the corresponding bank. A step S8 assigns the responding car to the destination floor, a step S9 displays the destination floor on the destination floor display device 7 of the corresponding car, and after in a step 10, the car arrives at the elevator hall of the entrance floor and the door opens, a step S11 detects riding, and thereafter, automatically registers the car call of the destination floor. When the validation result in the step S2 is NG, a step S12 does not cause the security gate 1 to open.

Embodiment 2

Figure 4:
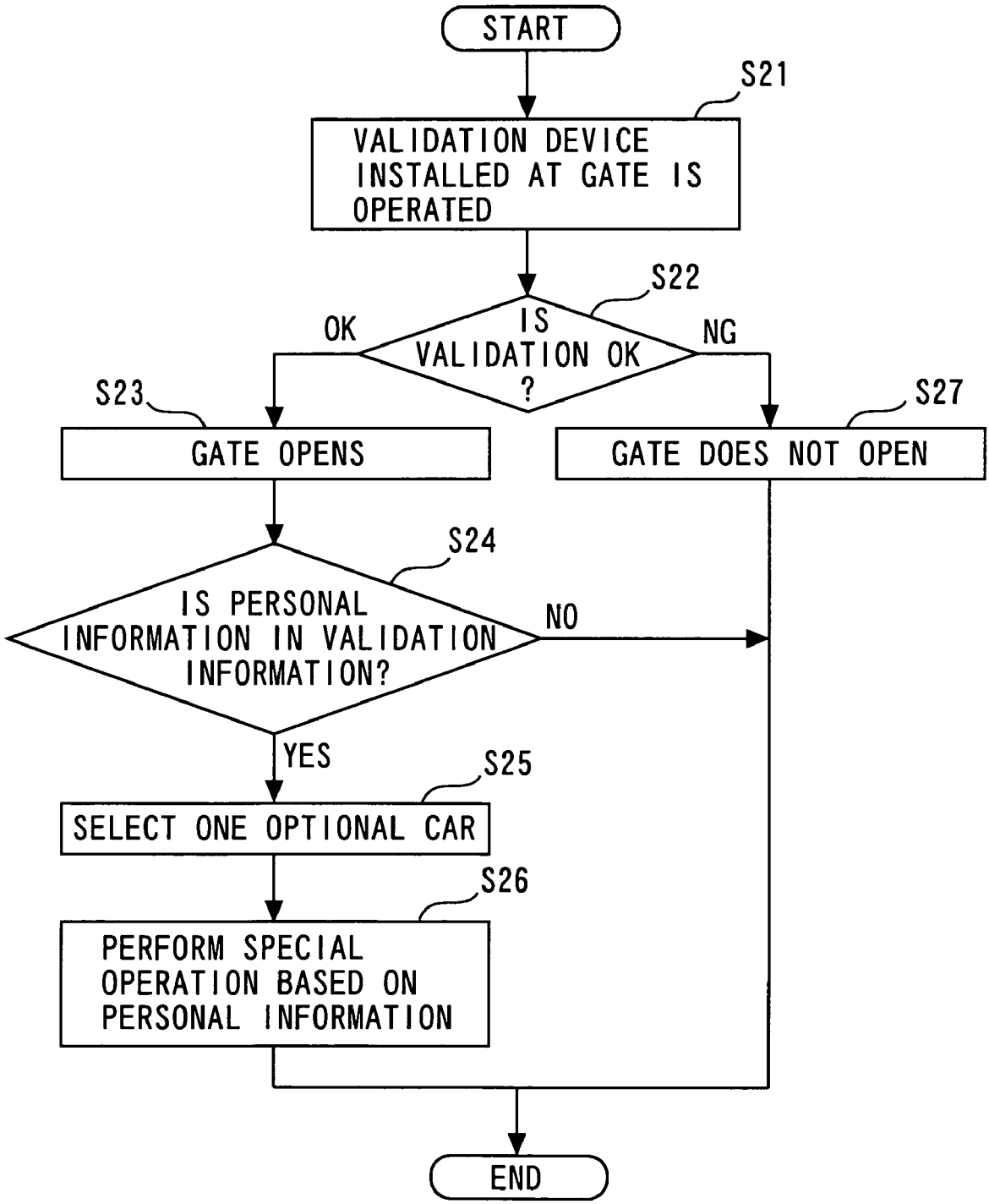
FIG. 4 is a flowchart showing an operation procedure of an elevator control system in embodiment 2 of this invention.

Next, an operation procedure of an elevator control system in embodiment 2 of this invention will be described based on a flowchart in FIG. 4.

When a step S21 detects that the validation device 2 placed at the security gate 1 operates, a step S22 determines OK or NG of the validation result. When the validation result is OK, a step S23 opens the security gate 1, and a step S24 determines whether the personal information exists in the validation information or not. When the personal information is included in the validation information, a step S25 selects an optional car from a plurality of cars, and a step S26 performs operation of the elevator based on the personal information by the special operation selection means in the operation control means 5A. The personal information mentioned here is the personal information such as a female, a physically handicapped person and a VIP, for example, and the selected car performs an operation corresponding to the personal information, for example, an operation only for women, an operation for a physically handicapped person, a VIP operation and the like. When the validation result in the step S22 is NG, a step S27 does not cause the security gate 1 to open.

Embodiment 3

Figure 5:
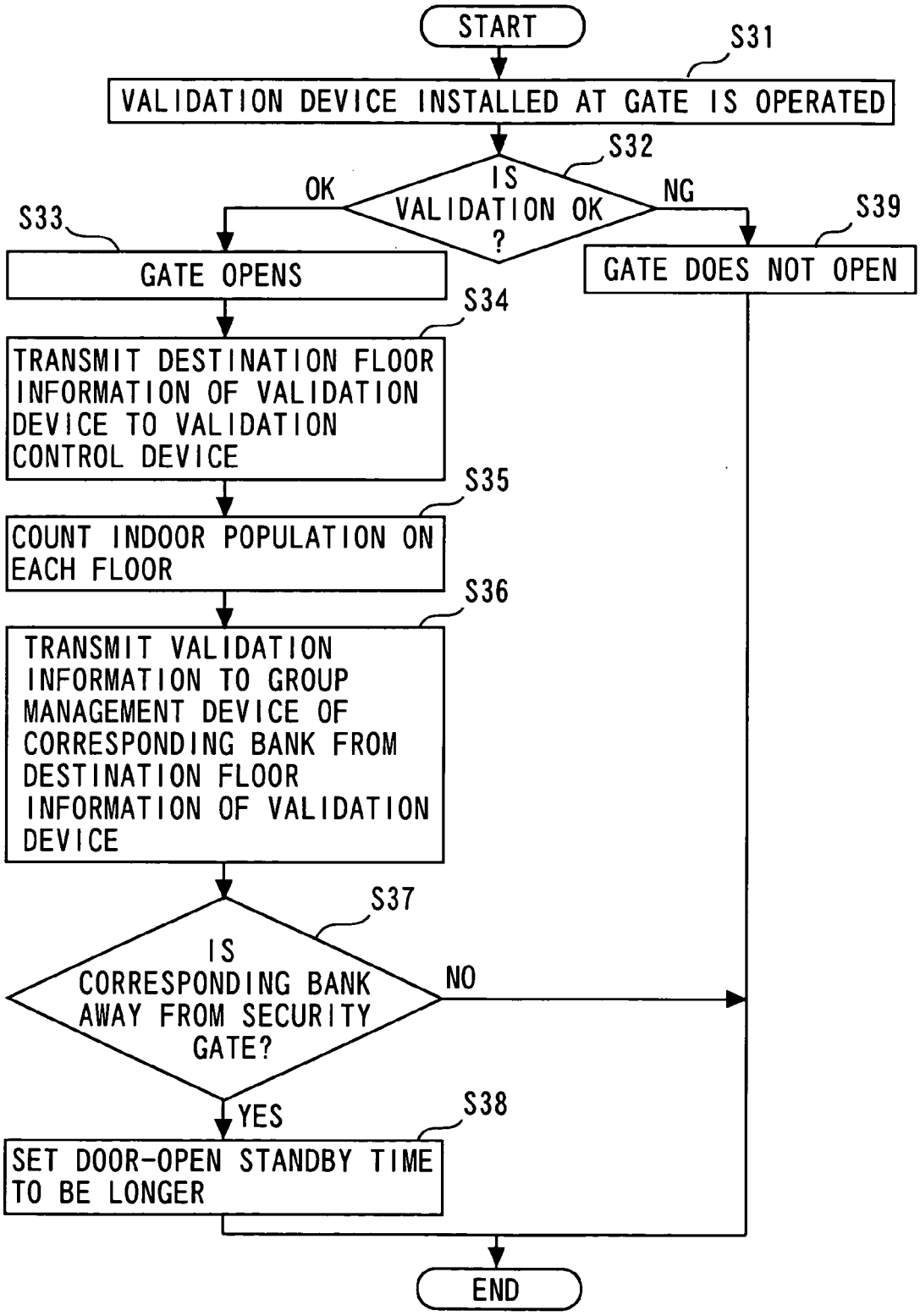
FIG. 5 is a flowchart showing an operation procedure of an elevator control system in embodiment 3 of this invention.

Next, an operation procedure of an elevator control system in an embodiment 3 of this invention will be described based on a flowchart in FIG. 5.

When a step S31 detects that the validation device 2 placed at the security gate 1 operates, a step S32 determines OK or NG of the validation result. If the validation result is OK, a step S33 causes the security gate 1 to open, a step S34 transmits the destination floor information of the validation device 2 to the validation control device 3, and a step S35 counts the indoor population on each floor by the indoor population counting means 3A. When this information is linked to, for example, the building management system (not shown), this information can be applied to the functions of turning off the illumination of a corresponding floor, making the elevator service temporarily unavailable and the like when there is no person on the floor of the building, by transmitting the indoor population information of each floor. Then, a step S36 transmits the validation information of the elevator group management device 5 of the corresponding bank, and a step S37 determines whether the corresponding bank is away from the security gate 1 or not. As a result of this determination, when the security gate 1 is away from the corresponding bank, a step S38 sets the door-opened standby time in the elevator hall of the entrance floor to be adjusted to be longer. For example, when a morning office arrival time operation is selected, a car to start first is on standby with the door opened for a predetermined time on the entrance floor, and by setting the door-opened standby time to be adjusted in accordance with the distance from the security gate 1, missing the car or the like is prevented. When the validation result in the step S32 is NG, a step S39 does not cause the security gate 1 to open.

In the embodiments, the example with a plurality of banks is described, but the same construction can be realized with the single bank. As for the use purpose of the building, the same construction can be realized not only in the office building but also in the large-scale apartments and hotels.

INDUSTRIAL APPLICABILITY

As described above, in the elevator control system of the present invention is preferable for use in a control system which assigns a car in accordance with the destination floor from the validation information at the security gate and automatically registers the destination call, in a system in which an elevator group management device which manages a plurality of elevators as a group is installed, the validation device is installed at the security gate installed at the entrance of the building, and when validation is made by the validation device, the security gate opens to allow the validated person to move to the elevator hall of the entrance floor.

The invention claimed is:

1. An elevator control system in which an elevator group management device which manages a plurality of elevators as a group is installed, a validation device is installed at a security gate installed at an entrance of a building, and when validation is made by the validation device, the security gate opens to allow a validated person to move to an elevator hall of an entrance floor, characterized by comprising:

validation information transmission means which transmits validation information to a corresponding bank out of a plurality of banks of the elevator hall based on destination floor validation information of said validation device;

indoor population counting means which counts indoor population of each floor from said validation information;

car assigning means which assigns a car to each destination floor of a passenger from said validation information;

destination floor display means which displays a destination floor on the entrance floor elevator hall for each assigned car; and call automatic registration means which automatically registers a destination call of the destination floor in the car when detecting riding of the passenger.

2. An elevator control system in which an elevator group management device which manages a plurality of elevators as a group is installed, a validation device is installed at a security gate installed at an entrance of a building, and when validation is made by the validation device, the security gate opens to allow a validated person to move to an elevator hall of an entrance floor, characterized by comprising:

validation information transmission means which transmits validation information to a corresponding bank out of a plurality of banks of the elevator hall based on destination floor validation information of said validation device;

car assigning means which assigns a car to each destination floor of a passenger from said validation information;

destination floor display means which displays a destination floor on the entrance floor elevator hall for each assigned car;

call automatic registration means which automatically registers a destination call of the destination floor in the car when detecting riding of the passenger; and special operation selection means which selects an operation peculiar to a user from personal validation information of said validation device.

3. An elevator control system in which an elevator group management device which manages a plurality of elevators as a group is installed, a validation device is installed at a security gate installed at an entrance of a building, and when validation is made by the validation device, the security gate to opens to allow a validated person to move to an elevator hall of an entrance floor, characterized by comprising:

validation information transmission means which transmits validation information to a corresponding bank out of a plurality of banks of the elevator hall based on destination floor validation information of said validation device;

car assigning means which assigns a car to each destination floor of a passenger from said validation information;

destination floor display means which displays a destination floor on the entrance floor elevator hall for each assigned car;

call automatic registration means which automatically registers a destination call of the destination floor in the car when detecting riding of the passenger; and standby time adjustment means which adjusts a door-opened standby time at the elevator hall of the entrance floor in accordance with a distance from said security gate to the corresponding bank.

* * * * *